US006406323B2

(12) United States Patent
Chung Long Shan

(10) Patent No.: US 6,406,323 B2
(45) Date of Patent: Jun. 18, 2002

(54) MULTI WIRE INSULATION DISPLACEMENT CONTACT AND A METHOD OF MAKING MULTI WIRE TERMINATIONS

(75) Inventor: Laval Chung Long Shan, Watanobbi (AU)

(73) Assignee: Krone GmbH (DE)

( * ) Notice: Subject to any disclaimer, the term of this patent is extended or adjusted under 35 U.S.C. 154(b) by 0 days.

(21) Appl. No.: 09/881,541

(22) Filed: Jun. 14, 2001

(30) Foreign Application Priority Data

Jun. 16, 2000 (AU) ..... 8199/00

(51) Int. Cl.[7] ..... H01R 4/24
(52) U.S. Cl. ..... 439/395; 439/408; 439/417
(58) Field of Search ..... 439/395, 402, 439/405, 404, 403, 418, 417, 409, 408

(56) References Cited

U.S. PATENT DOCUMENTS

| | | | | |
|---|---|---|---|---|
| 4,405,187 A | | 9/1983 | Müller et al. | |
| 4,452,502 A | | 6/1984 | Forberg et al. | |
| 4,533,201 A | * | 8/1985 | Wasserlein, Jr. | |
| 5,492,484 A | | 2/1996 | Archer | |
| 5,647,760 A | * | 7/1997 | Drach et al. | 439/395 |
| 5,820,404 A | * | 10/1998 | Chishima et al. | 439/417 |
| 5,934,930 A | * | 8/1999 | Camps et al. | 439/425 |

* cited by examiner

*Primary Examiner*—Tho D. Ta
*Assistant Examiner*—Phuongchi Nguyen
(74) *Attorney, Agent, or Firm*—McGlew and Tuttle, P.C.

(57) ABSTRACT

A method of positioning wires in the slot (18) of a bifurcated insulation displacement contact (10). The wires are positioned in the slot alternatively disposed with respect to the side-to-side direction ("A") of the slot. As between the or each successive pair of wires in the slot, the angle made between the wires of the pair is greater than that made by one of the wires with respect to the side-to-side direction of the slot.

15 Claims, 9 Drawing Sheets

MULTI WIRE INSULATION DISPLACEMENT CONTACT AND A METHOD OF MAKING MULTI WIRE TERMINATIONS

This invention relates to an insulation displacement contact and a method of making connections to wires.

Insulation displacement contacts may be formed from a contact element which is bifurcated so as to define two opposed contact portions separated by a slot into which an insulated wire may be pressed so that edges of the contact portions engage and displace the insulation and such that the contact portions resiliently engage and make electrical connection with the conductor of the wire. Such a contact is described in, for example U.S. Pat. Nos.4,452,502 and 4,405,187.

While, in some cases, making electrical connection to a single wire in the above way is all that is necessary, occasions arise where it would be useful to make connection to more than one wire by inserting the wires, one after the other, into the slot. With a carefully designed contact it may be possible to make connections in this way to two wires, but it is usually impossible to make effective connections to several wires. This arises because, during the process of introducing a first wire into the slot, the contact portions are resiliently deformed, such that the gap between them is to some extent increased. The resultant increase in slot width may still permit an adequate connection to be made to a second wire when inserted into the slot. However, the increased slot width may even be such that the contact portions fail to properly pierce the insulation, or it may otherwise leave the second wire unreliably gripped. This problem becomes worse as more wires are inserted.

The above problem is alleviated in Krone LSA-PLUS connectors by arranging that the contact portions are torsionally twisted during insertion of the wires. That is, the wires are introduced into the slot with their directions of extent arranged at an angle of about 45 degrees to the side to side direction of the slot, so that insertion of the wires tends to deflect contacting edges of the respective contact portions outwardly away from each other, in opposite directions relative to the general plane of the contact. In that case, it is possible to achieve good connection to two wires but even in this construction more than two wires may not be adequately accommodated.

U.S. Pat. No. 5,492,484 also describes a particular form of contact that is indicated as being able to terminate more than a single conductor. This is however complicated in form.

It is an object of the invention, in one aspect, to provide a method making electrical connection to a plurality of insulated wires and an electrical connector useful in practising the method.

In one aspect, there is provided a method of making electrical connection to wires having insulated conductors, using a contact element which is bifurcated so as to define two opposed contact portions separated by a slot, in which the wires are positioned in the slot successively, with the directions of extent of the wires, or of groups of commonly aligned ones thereof being alternatively disposed with respect to the side-to-side direction of the slot and such that, as between the or each successive pair of wires in the slot, the angle made between the wires of that pair is greater than that made by one of the wires with respect to the side-to-side direction.

The invention also provides a method of making electrical connection to wires having insulated conductors, using a contact element which is bifurcated so as to define two opposed contact portions separated by a slot, in which the wires are positioned in the slot successively, with the directions of extent of the wires, or of groups of commonly aligned ones thereof, alternatingly arranged at angles which are at opposite sides of the perpendicular to the side to side direction of the slot, so that edges of the contact portions engage and displace the insulation and such that the contact portions resiliently engage and make electrical connection with the conductors of the wires.

The invention also provides an electrical connector having body which supports a contact element which is bifurcated so as to define two opposed contact portions separated by a slot in which insulated wires may be successively positioned so that edges of the contact portions engage and displace the insulation of the wires and such that the contact portions resiliently engage and make electrical connection with the conductors of the wires, wherein the body is provided with wire guide means for guiding the wires during positioning in the slot such that, as between the or each successive pair of wires in the slot, the angle made between the wires of that pair is greater than that made by one of the wires with respect to the side-to-side direction. The wire guide means may be arranged such that wires successively positioned in said slot are disposed in respective first and second dispositions, ones of the wires in said respective first and second dispositions extending at angles to the side to side direction of the slot which are respectively to opposite sides of a perpendicular to the side to side direction.

The contact element may be formed of a generally planar element such that the side to side dimension of the slot is generally aligned with the plane of the contact element.

The wire guide means may be formed as channels arranged to extend at an angle to each other, the connector having means for supporting the insulation displacement contact so that when the insulated wires are entered positioned in the channels, the wires extend angularly with respect to each other for said electrical connection to the conductors thereof by the contact element. The channels may extend inwardly of the body in the same directional sense, but such that the longitudinal directions of extent of these cross. In this case with one channel may be deeper than the other so that an inner one of said wires may first be located in the deeper channel and an outer one of the wires then laid thereover in the less deep channel.

Alternatively, the channel may be disposed in a side wall of the body. The channels may then be sidewardly open for receiving the wires. The contact may be slidable with respect to the body, between a position at which it is at least substantially withdrawn from the channels and a position at which it is moved to make insulation displacement contact with wires received in the channels. The channels may also be peripherally closed, but open at at least one end thereof for longitudinal insertion of the wires.

In a preferred method, the contact portions are subjected to torsional forces during insertion of a said wire, the directions of action of those forces, as arising from positioning of respective wires or groups of wires in said slot, being oppositely directed.

In another aspect, the invention provides a method of making electrical connection between electrically insulated wires and a bifurcated insulation displacement contact in which the wires are so positioned in a slot between opposed contact portions of the contact that the contact portions are subjected to torsional forces during positioning of said wires in the slot, the directions of action of those forces as due to successive ones of the wires in the slot, being oppositely directed.

In another aspect the invention provides an electrical connector having a bifurcated insulation displacement contact having opposed contact portions with a slot therebetween whereby insulated wires may be positioned in the slot such that the contact portions displace the insulation of the wires to make electrical connection to conductors of the wires, the connector having wire guide means for locating the wires with respect to the contact, arranged whereby the positioning of the wires in the slot causes the contact portions to be subjected to torsional forces, the directions of action of those forces, as due to successive ones of the wires when positioned in the slot, being oppositely directed.

The invention is further described by way of example only with reference to the accompanying drawings in which.

Figure 8:
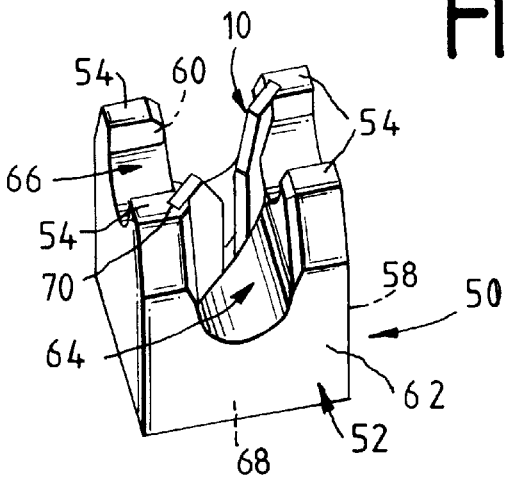
Figure 9:
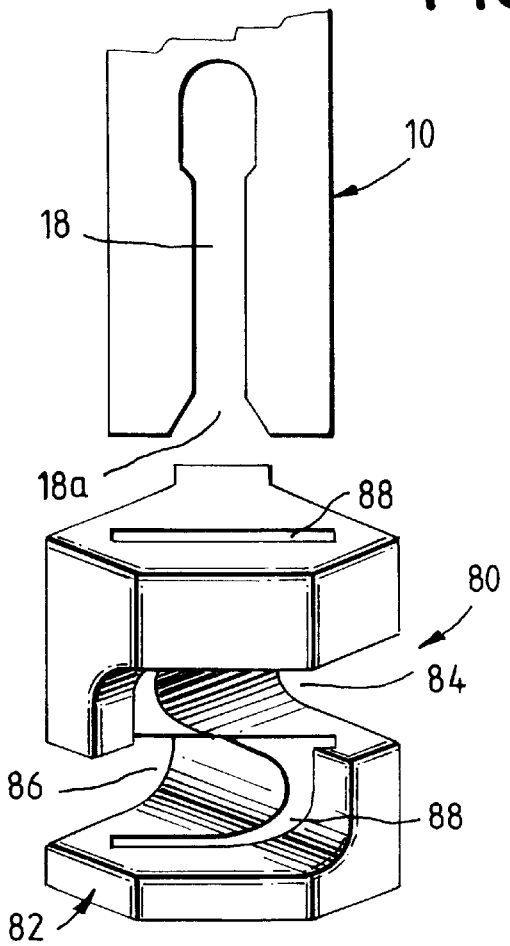
Figure 10:
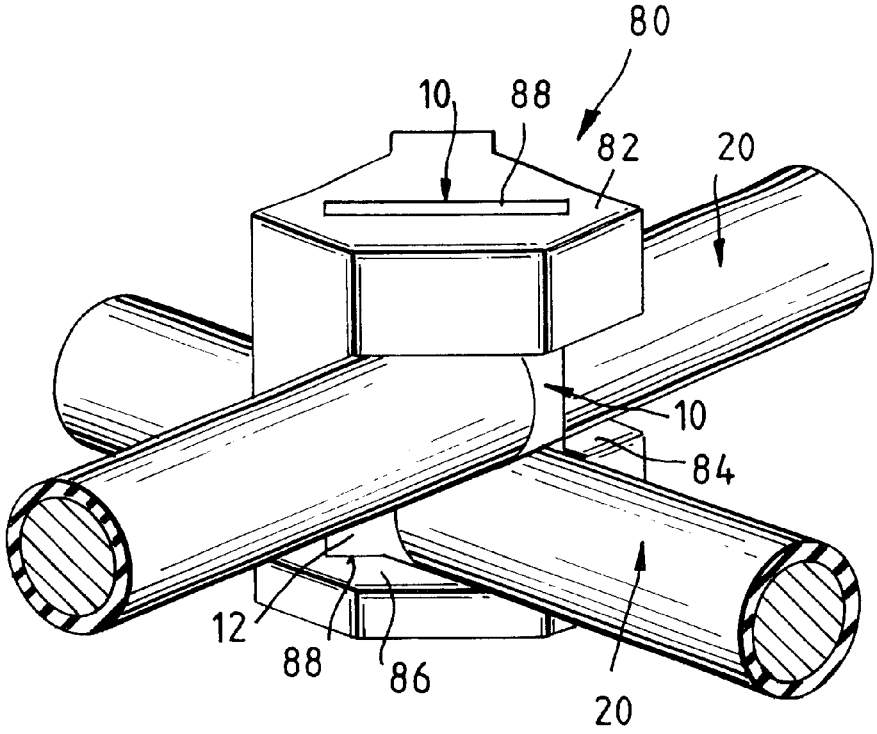
Figure 11:
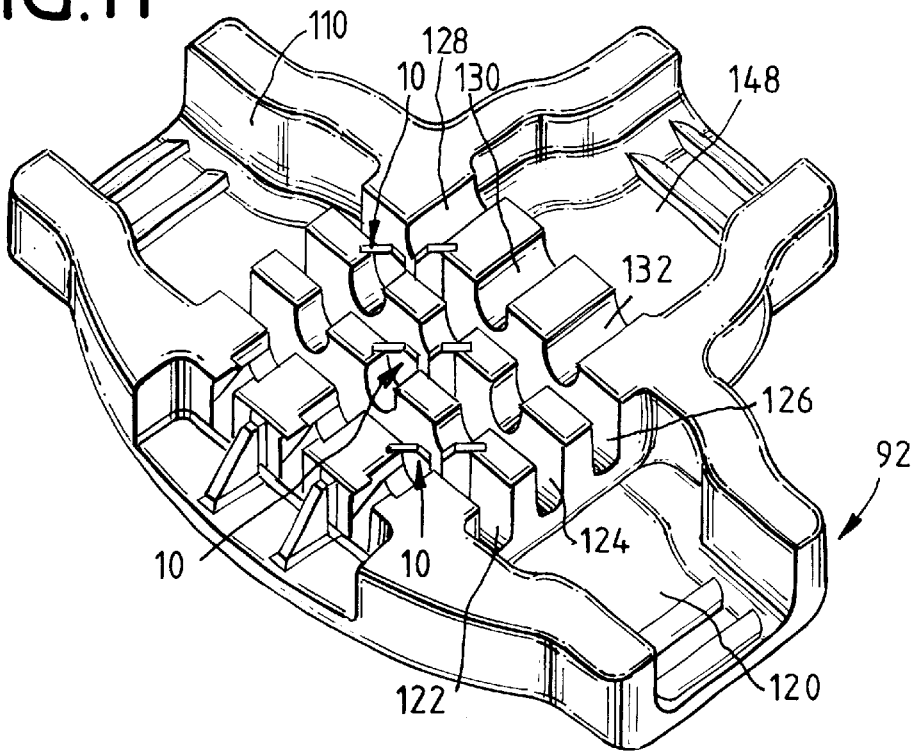
Figure 12:
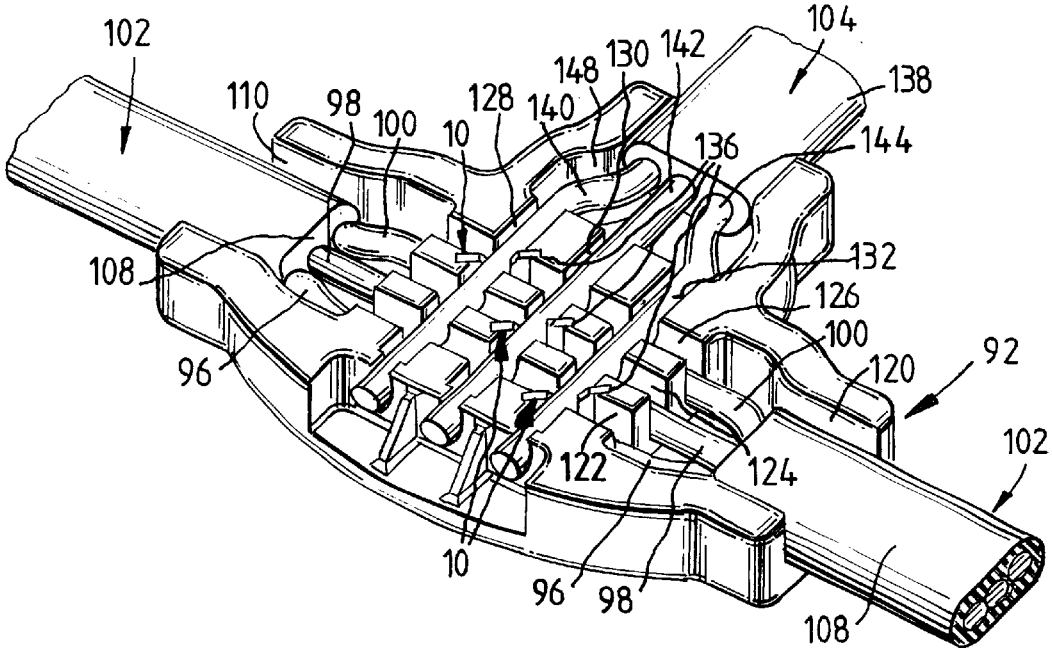
Figure 13:
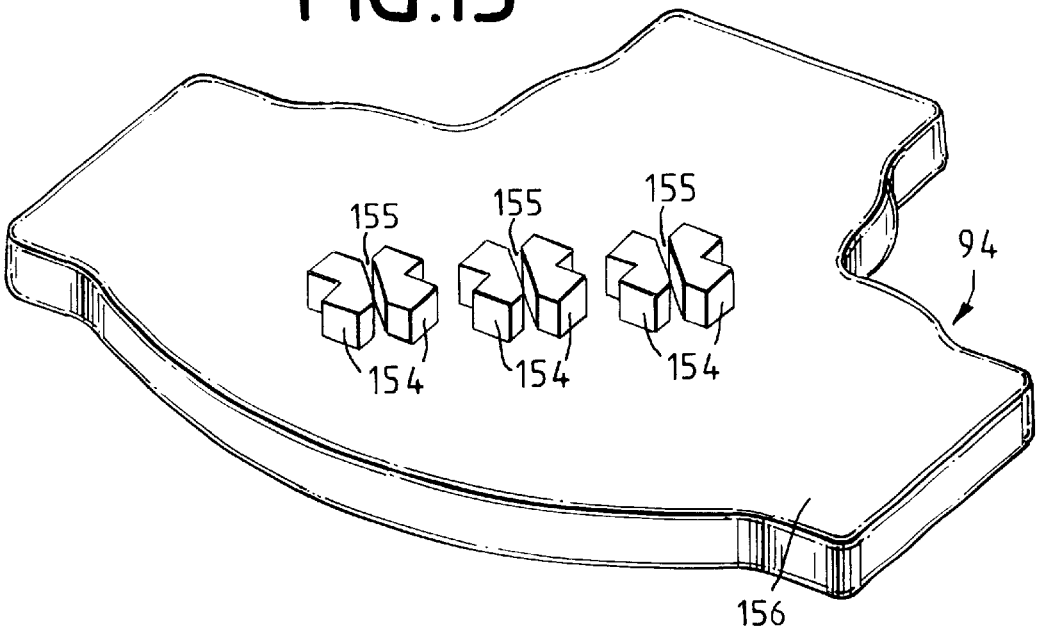
Figure 14:
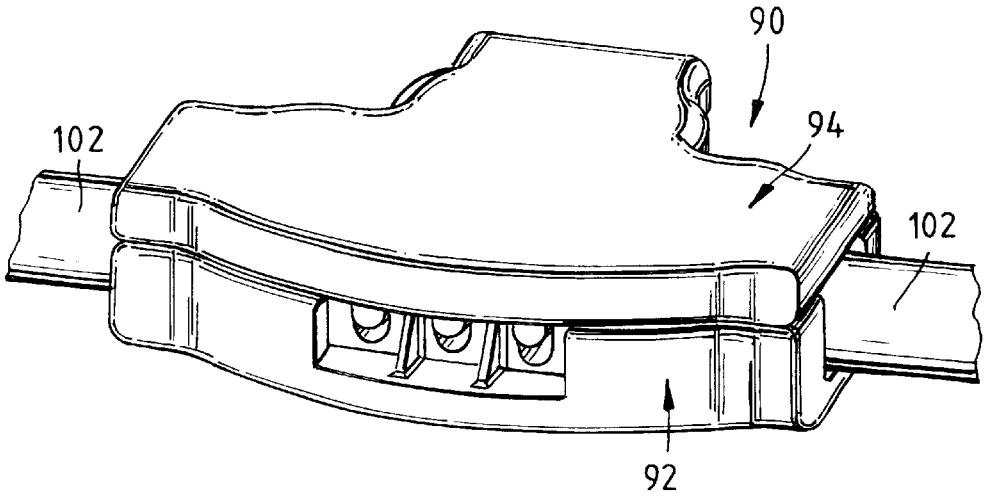
Figure 15:
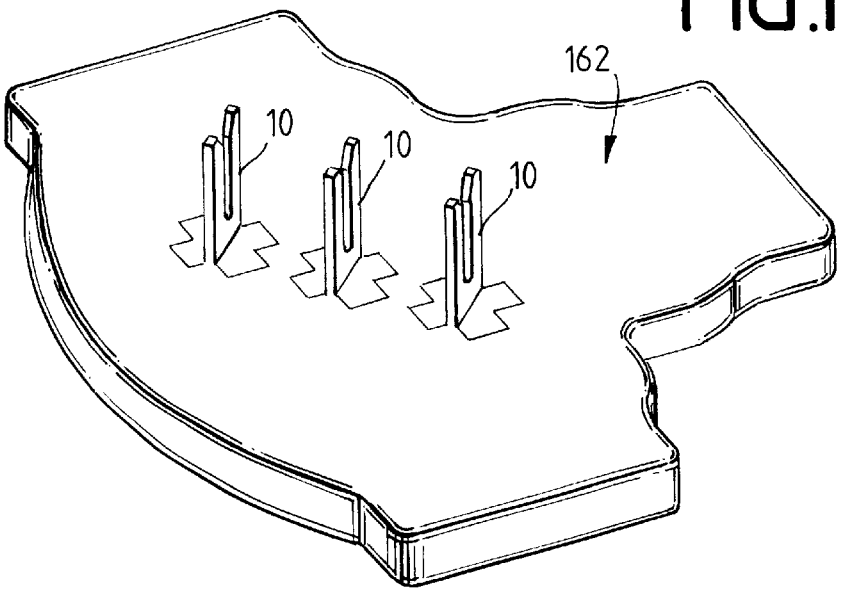
Figure 16:
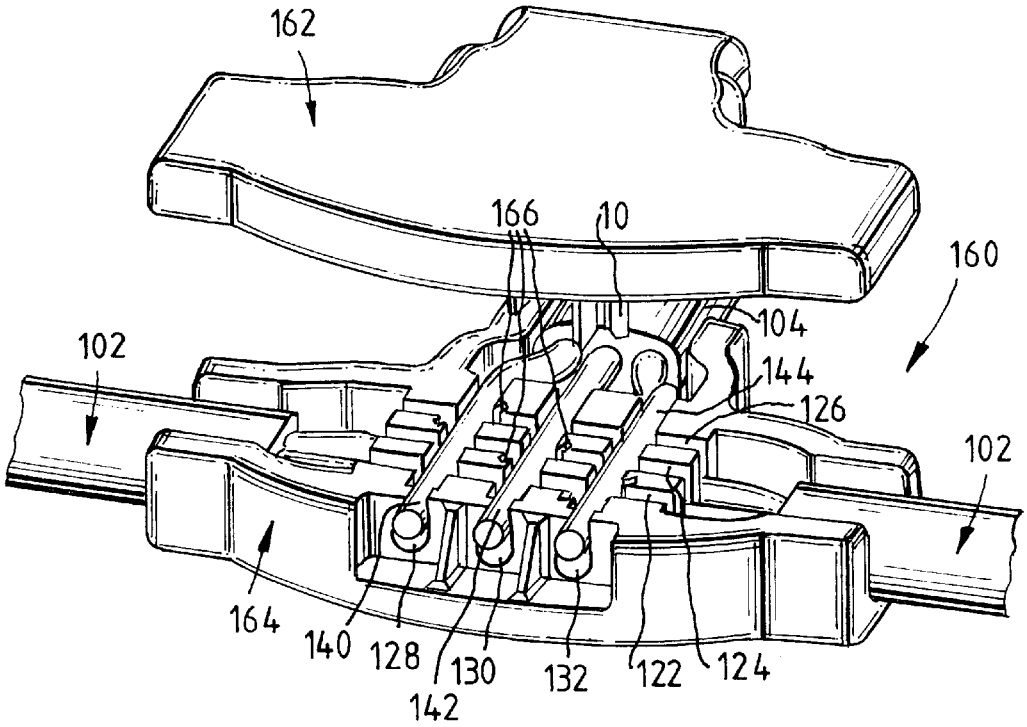

FIGS. 7(*a*), 7(*b*), 7(*c*) and 7(*d*) are respective plan, perspective, front and side views of a contact with multiple wires connected thereto, in accordance with the invention;

FIG. 8 is a perspective view of an electrical connector constructed in accordance with the invention;

FIG. 9 is an exploded perspective view of another electrical connector constructed in accordance with the invention;

FIG. 10 is a perspective view like FIG. 9 but showing the electrical connector of FIG. 9 in use;

FIG. 11 is an upper side perspective view of part of a further electrical connector constructed in accordance with the invention;

FIG. 12 is a view like FIG. 11 but showing wires positioned on the connector part of FIG. 11;

FIG. 13 is an underside perspective view of another connector part which cooperates with the connector part of FIGS. 11 and 12;

FIG. 14 is a perspective view of an assembled connector formed from the connector parts of FIGS. 11, 12, and 13;

FIG. 15 is an underside perspective view of part of a still further electrical connector constructed in accordance with the invention; and FIG. 16 is an exploded perspective view of an electrical connector including the part illustrated in FIG. 15.

Figure 1:
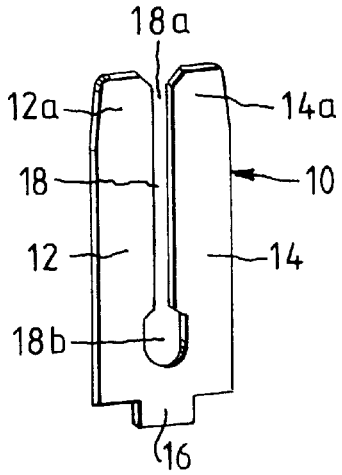
FIG. 1 is diagrammatic perspective view of an insulation displacement contact
Figure 2:
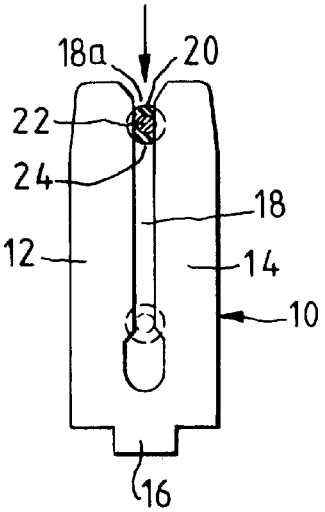
FIG. 2 is a diagrammatic front view of the contact of FIG. 1, illustrating how a wire is inserted thereinto for the purpose of making electrical contact between the wire and the contact.
Figure 3:
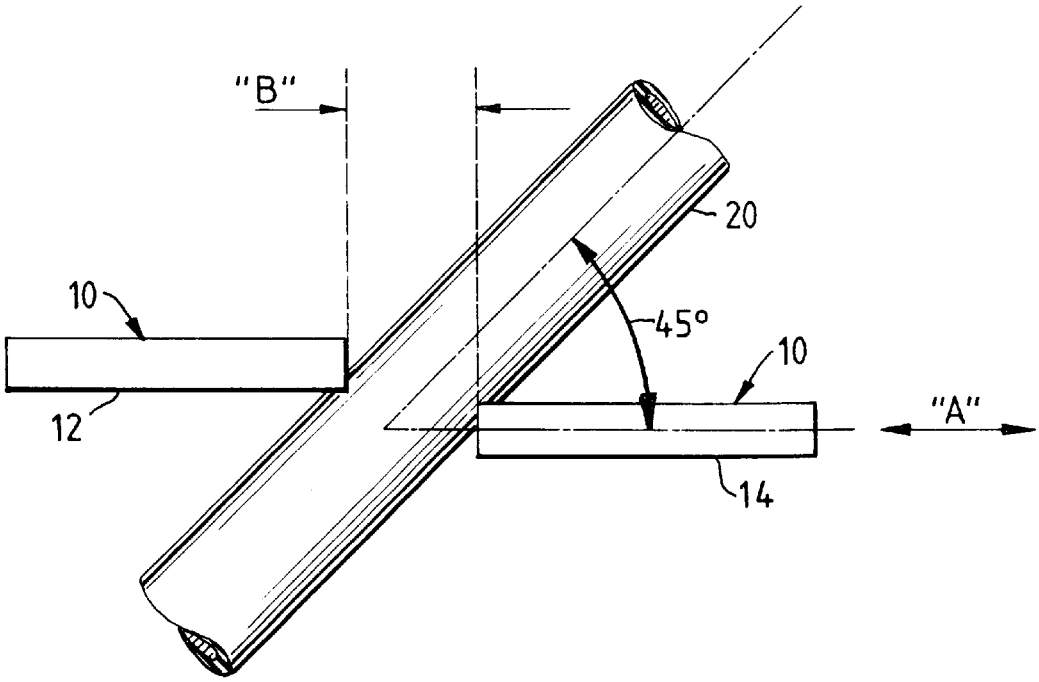
FIG. 3 is an enlarged plan view of the contact and wire of FIG. 2.

FIGS. 1 to 3 illustrate a bifurcated insulation displacement contact 10. This is formed such as by stamping from electrically conductive sheet material. It comprises a pair of parallel contact portions 12, 14 which extend from a base portion 16 of the contact to adjacent but spaced free ends 12*a*, 14*a*. A slot 18 is thus defined between the contact portions.

Connection is made to an insulated wire 20 by pressing it downwardly into the slot 18 as shown in FIG. 2. In this embodiment of the invention, the wire 20 is so inserted with the direction of extent of the wire arranged at an angle of 45° to the side to side direction "A" of the slot, as shown in FIG. 3. Wire 20, when so inserted, passes into the slot 18 at the open end 18*a* between the free ends 12*a*, 14*a* of the contact portions 12, 14 and is pressed toward the inner end 18*b* of the slot 18, adjacent the base portion 16. The diameter of the conductor 22 of the wire 20 is slightly greater than the side to side dimension "B" of the slot 18, and the inner edges of the contact portions 12, 14 pierce the outer insulation 24 of the wire, and resiliently contact the conductor 22. Generally, the resultant contact will result in slight notching of the conductor 22.

Figure 4:
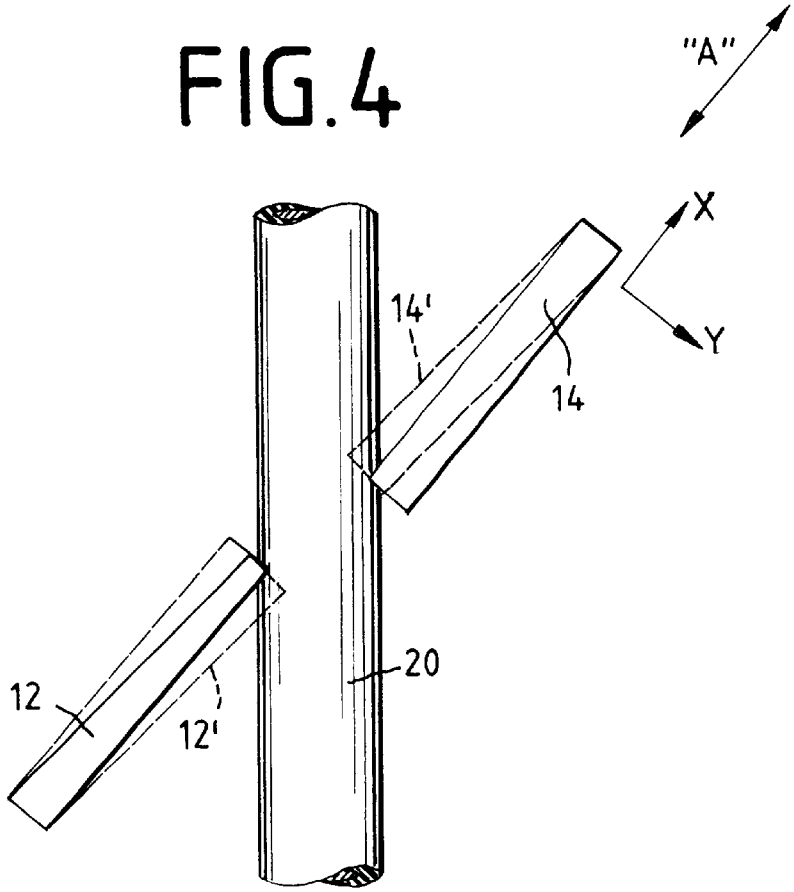
FIG. 4 is a diagrammatic plan view of the contact and wire of FIG. 2, illustrating how contact portions of the contacts are deformed during wire insertion.
Figure 5:
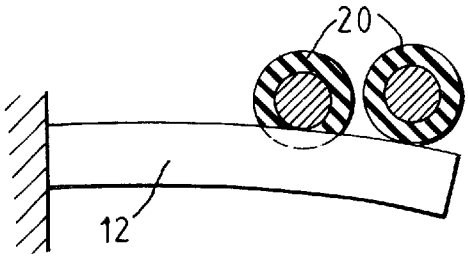
FIG. 5 is a diagram illustrating contact deformation during wire insertion.

FIGS. 4 and 5 illustrate the displacement of the contact portions 12, 14 when the wire 20 is inserted.

In FIG. 4, the broken lines 12', 14' show the contact portions 12, 14 in their original state; that is, before any wire is positioned in the contact. When a wire 20 is pushed into the contact 10, the contact portions 12, 14 will deflect outwardly and oppositely, and twist to adopt the configuration shown in solid lines in FIG. 4. This action arises because of the introduction of the wire 20 at 45° to the side-to-side direction of the slot 18. Referring particularly to FIG. 4, the resulting displacement has two components, a component, "X", which is parallel to the side to side direction "A" of the slot (i.e. parallel to the plane of the contact), and a component "y" which is perpendicular to the direction "A". The parallel, X, component induces bending stresses in the contact portions 12, 14 whereas the perpendicular, "y", component induces torsional stress in the contact portions.

Using conventional contacts of form somewhat similar to that shown in FIGS. 1 to 3 has in the past restricted terminating of subsequent wires in the slot 18 so that, at most, a total of two wires of small diameter, about 0.5 mm square can be reliably accommodated. As mentioned, when a second wire 20 is terminated in the slot 18, directly above the first wire, the contact pressure, and therefore the conductivity, between the contact region on the wire and the contact portions 12, 14 is substantially less than for the first wire. This particularly arises because of the common connection of the inner ends of the contact portions 12, 14 to the base portion 16. The contact portions 12, 14 are, essentially, parallel cantilevered beams, with the base portion 16 constituting a common hinge point for the contact portions, so that the second wire, which is further away from that hinge point, will induce a lower bending moment than the first wire. The depth of the notches in the second wire, arising from contact with the contact portions 12, 14, is also less than for the first wire, because the deflection of the contact portions 12, 14 increases as the distance from the common hinge increases. This action is illustrated diagrammatically in FIG. 5.

In order to facilitate terminate of multiple wires in the same contact slot, the deflection of the contact portions 12, 14 arising when a wire is inserted may be limited, and reactive force between the contact portions and the notched wires may be increased.

The "X" component of the deflection and reactive force can be optimised by stiffening the contact portions 12, 14, for example by increasing the width of them in the direction "A", or by forming them of stiffer material.

Figure 6:
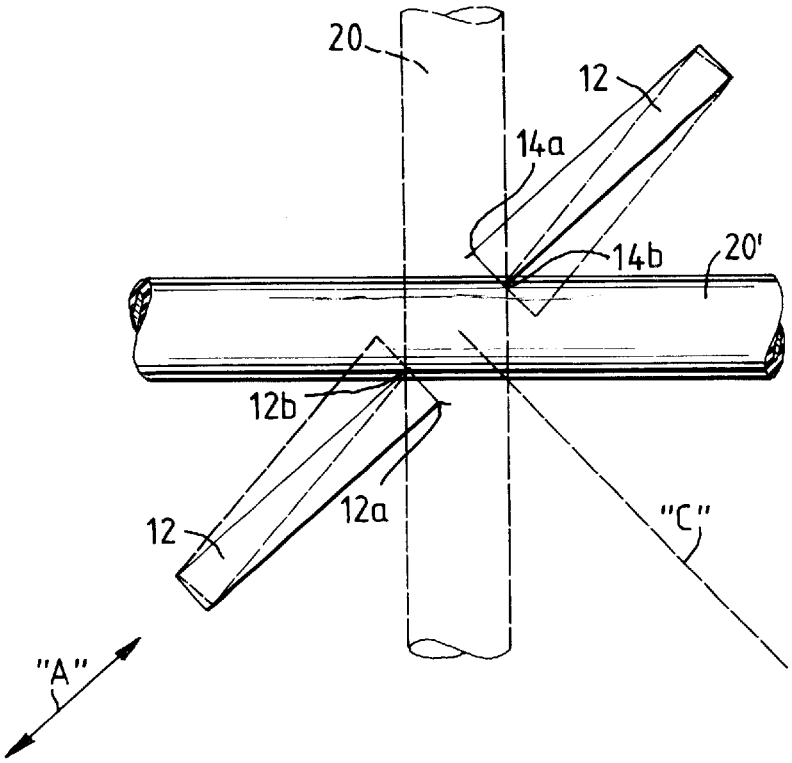
FIG. 6 is a diagram like FIG. 4, but illustrating the effect of insertion of a second wire into the contact.
Figure 7D:
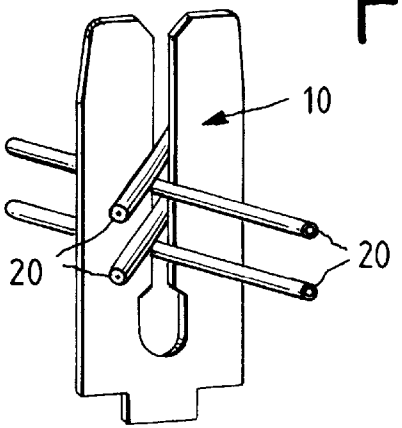
Figure 7B:
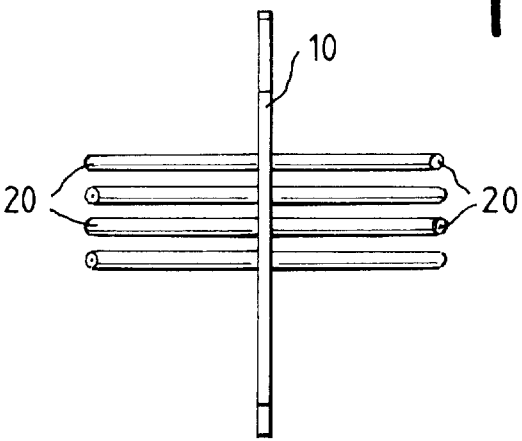
Figure 7C:
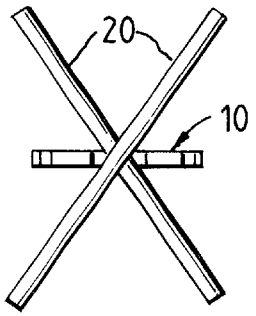
Figure 7A:
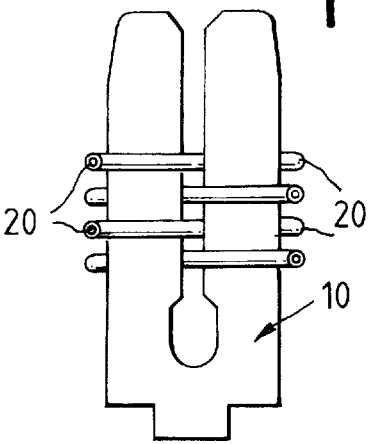

The "y" components of the reactive force are, in accordance with the teachings of the invention, increased by terminating the first and second, and subsequent, wires in a crisscross pattern as indicated on FIG. 6. By this successive wires 20, 20' are inserted the slot 18 such that portions of these at one side of the contact element 10 extend away from the contact element 10 such as to be alternatingly disposed to opposite sides of the perpendicular "C" to the direction of extent "A" of the width of the slot 18, i.e, perpendicular to the general plane of the contact. In this case, the angle between any two successive wires is greater than the angle between the first wire and the perpendicular "C". By this, corners 12*b,* 14*b* of the respective contact portions 12, 14, which contact and notch the second laid wire 20' in of a pair of successively laid in wires, are opposite to the comers 12*a,* 14*a* of each contact portion that contact and notch the first laid in wire 20 of that pair. Thus the second wire 20' tends to deflect the contact portions 12, 14 oppositely to the deflections of the deflections tending to be introduced by the first wire. Therefore, the insertion of the second wire 20' increases the "y" component of the reactive force between the first wire and the contact portions 12, 14, while the first wire increases the component of the reactive force between the second wire and the contact portions 12, 14.

The described method of inserting wires results in the contact portions 12, 14 being woven in between the wires. The weaving effect has two beneficial effects. First, greater torsional forces are produced, which increases the reactive force between the wires and the contact portions. Second, deflection due to the first wire actually results in a small slot width for the second wire; the contact portions being deflected outwards.

By inserting the wires in a crisscross pattern, it is thus possible to satisfactorily terminate multiple wires in the contact 10. FIGS. 7(*a*), 7(*b*), 7(*c*) and 7(*d*) illustrate how four wires may be terminated in this fashion.

In order to facilitate insertion of wires in the described way the contact 10 may be provided with guide structure for guiding wires so that these can be inserted. FIGS. 8 to 16 describe connectors embodying guide structures of this kind.

The connector 50 shown in FIG. 8 has a guide structure formed as a somewhat cuboidal insulative body 52 having an upper surface 54, a first pair of opposed side surfaces 56, 58 and a second pair of opposed side surfaces 60, 62, with the surfaces 56 and 58 being parallel to each other and the surfaces 60, 62 being parallel to each other and arranged substantially at right-angles to the surfaces 56, 58.

Two channels 64, 66 are provided in the body 52, each extending inwardly (i.e. downwardly as viewed in FIG. 8) from the upper surface 54. Channel 64 is relatively deep and extends downwardly from surface 54 towards a base surface 68 of the body 52. Channel 64 has generally parallel sides and a radiussed inner end surface. Channel 64 extends between surfaces 56, 58. Channel 66 extends downwardly from surface 54 to about half the depth of slot 64. Channel 66 extends between surfaces 60, 62, and is parallel sided, with a radiussed inner end surface.

An insulation displacement contact 10 formed as previously described, is held within a side-to-side elongate slot 70 in body 52, which slot extends downwardly from surface 54 to a location adjacent the base surface 68. Viewed from above as represented in FIG. 8, the slot 70 extends with its longer cross-sectional dimension arranged at 45° to the directions of extent of both of the channels 64, 66 and crosses and breaks into these. The insulation displacement contact 10 is thus located within slot 70 so that the direction "A" thereof also extend at 45° to the directions of extent of the channels 64, 66. Portions of the contact portions 12, 14 and the slot 18, are disposed within each channel 64, 66.

The slot 18 in insulation displacement contact 10 is upwardly open. A first insulated wire 20 may be positioned above surface 54, with its direction of extent parallel to the channel 64, and thereafter pressed downwardly to enter the channel 64 and also the slot 18 in insulation displacement contact 10 so that the insulation of the wire is cut and electrical contact is made between the inner conductor of the wire and the insulation displacement contact 10. Then, a second wire 20 may be aligned with the channel 66 and, after positioning above surface 54, parallel to the channel 66, then pressed downwardly to be received in the channel 66, and be pressed into the slot 18 in the insulation displacement contact 10, to again make electrical connection thereto. By this, wires in the channels 64, 66 are entered successively, one above the other as viewed in FIG. 8, and at 90° to each other and 45° to the contact 10.

The electrical connector 80 shown in FIGS. 9 and 10 has a body 82 with two channels 84, 86 which extend inwardly from the peripheral surface of the body 82, one above the other as viewed in FIG. 9, and each at right-angles to each other. A slot 88 is provided in the body 82, this being similar to the described slot 70 in body 52 of connector 50. Slot 88 is able to neatly and slidable accommodate an insulation displacement contact 10. The contact may be slid within slot 88 to a position at which it intersects both channels 84, 86. However, to use the connector 80, wires 20 are first pressed sidewardly into respective ones of the channels 84, 86, with the insulation displacement contact 10 withdrawn from body 82, or at least withdrawn in the slot 88 such that it does not extend into channels 84, 86. Then, the insulation displacement contact 10, with the open end 18 a of contact slot 18 positioned downwardly, is moved downwardly in the slot 88 and to make insulation displacement contact with the wires 20 as shown in FIG. 10. The slot 88 is arranged with its longer transverse dimension at 45° to the direction of extent of the channel 86, and thus the wires 20 when received in the channels 84, 86, extend such that the major plane of the contact 10 intersects the wires at 45°, with the wires, again, disposed at 90° to each other.

FIG. 11 to 14 illustrate another connector 90. This is of two-part construction having a lower part 92 (FIGS. 11 and 12) and an upper part 94 (FIG. 13). This connector 90 is designed to make connection between three insulated wires of a first cable 102, each to a respective one of three insulated wires of a second cable 104. The wires 96, 98, 100 of the first cable 102 comprise inner conductors individually insulated, but the three insulated wires are also surrounded by an insulating covering 108 of the cable. At two opposite, lateral, ends, the part 92 has aligned cable channels 110. 120 which in use accommodate the cable 102, including its outer insulative covering 108. At an intermediate portion of the cable, extending between the cable channels 110, 120, the outer covering is stripped from the cable over the length "L" shown leaving the three individually insulated wires 96, 98, 100 to extend in somewhat parallel condition between these. These wires are accommodated in individual wire channels 122, 124, 126 of part 92, extending between the cable channels 110, 120. The wire channels 122, 124, 126 are relatively deep.

Three further wire channels 128, 130, 132 are provided in the part 92. These extend at right angles to wire channels 122, 124, 126, and intersect them. Wire channels 128, 130, 132 are only about half the depth of wire channels 122, 124, 126. Insulated wires 140, 142, 144 of the second cable 104, stripped of an outer insulative cable covering 138 thereof are laid into these three channels over the tops of the three insulated wires 122, 124, 126 so as to cross these and to extend normally thereto, and thence slightly outwardly from the part 92. Somewhat away from the location where wires 96, 98, 100 cross wires 140, 142, 144, the cable 104, with its covering 138, is accommodated within a cable channel 148 in the part 92, the latter extending at 90° to the cable channels 110, 120.

Three insulation displacement contacts 10 are disposed in receiving slots 136 in the part 92 and are positioned with the major planes of these at 45' to the directions of extent of the channels 122, 124, 126, 128, 130, 132, and of the wires when received in these, and so that slots 18 thereof are positioned at locations where respective pairs of the wire channels 126, 128; 124, 130; 122, 132 intersect. The slots 18 are upwardly open as viewed in FIGS. 11 and 12, and are open in each pair of channels which intersect at the location of the respective contact 10.

In use of the connector 90, the wires 96, 98, 100, 140, 142, 144 are pressed downwardly to enter into the respective wire channels 122, 124, 126, 128, 130, 132, as described and to enter the slots 18 of the insulation displacement contacts.

The upper part 94 of the connector is designed to be positioned over the part 92, cover part 92, and close the cable channels 110, 120, 140 so as to clamp the cables 102, 104 in the cable channels. Part 94, when so positioned on part 92, also closes the wire channels 126, 128; 124, 130; 122, 132, and otherwise cooperates with the part 92 to form a housing of the connector.

Part 94 is generally planar and has projections 154 which are formed on an underside surface 156. Projections 154 are arranged such that when part 94 is positioned on part 92, they press downwardly on the wires within the wire channels of part 94, at locations where these wire channels cross, so as to push the pairs of crossed wires within the wire channels to be pressed firmly down into the insulation displacement contacts 10. The completed assembly is shown in FIG. 14. In this arrangement each contact 10 receives and makes electrical connection to the two crossed wires immediately thereabove. By this, the wires within each wire pair 100, 140; 98, 142; 96, 144 are electrically connected.

The projections 154 are arranged in three pairs and are of somewhat "L"-shaped configuration. Each pair presents a cruciform outer periphery such that arms of the cruciform can fit into the intersections of the respective pair of wire channels at the location of each contact 10. Each pair also defines an angled slot 155 therebetween for accommodating a respective contact 10.

Suitable latching means (not shown) may be employed to mechanically couple parts 92, 94 together, in the completed connector 90.

FIG. 15 and 16 show an arrangement similar to that in FIGS. 11 to 14. Here, the connector 160 has upper and lower parts 162, 164. As shown in FIG. 16, the part 164 is similarly formed to the part 92, and like reference numerals in FIG. 11 denote like parts in FIG. 16. However, part 164 does not have contacts 10 positioned therein, merely having slots 166 able to accommodate the insulation displacement contacts. The part 162 is also similar to the part 94 but does not have the described projections 154. Instead, it has three insulation displacement contacts 10 which are fixed to the undersurface thereof. When the parts 162, 164 are assembled as the contacts 10 (which are then downwardly open), enter the slots 166 so as to be retained therein and to make insulation displacement contact with the wires of the two cables 102, 104. Prior to assemblies, the wires of the cables 102, 104 are arranged in wire channels on part 164, in similar fashion to that described with reference to FIGS. 11 to 14.

Although, in the embodiment of FIGS. 9 and 10, for example, the channels 84, 86 are sidewardly open, they might be closed, but open at one end to allow the wires to be inserted. Generally, this arrangement is possible in cases where the contact means with respect to the body, for effecting connection to the wires.

The described arrangement has been advanced merely by way of explanation any many modifications may be made thereto without departing from the spirit and scope of the invention which includes every novel feature and combination of novel features herein disclosed.

Throughout this specification and the claims which follow, unless the context requires otherwise the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that prior art forms part of the common general knowledge in Australia.

| Parts List | |
|---|---|
| contact | 10 |
| contact portions | 12, 14 |
| spaced free ends | 12a, 14a |
| broken lines | 12', 14' |
| base portion | 16 |
| slot | 18 |
| open end | 18a |
| inner end | 18b |
| insulated wire | 20 |
| conductor | 22 |
| outer insulation | 24 |
| connector | 50 |
| insulative body | 52 |
| upper surface | 54 |
| opposed side surfaces | 56, 58 |
| opposed side surfaces | 60, 62 |
| channels | 64, 66 |
| base surface | 68 |
| elongate slot | 70 |
| electrical connector | 80 |
| body | 82 |
| channels | 84, 86 |
| slot | 88 |
| connector | 90 |
| lower part | 92 |
| part | 94 |
| wires | 96, 98, 100 |
| first cable | 102 |
| second cable | 104 |
| insulating covering | 108 |
| cable channels | 110, 120 |
| wire channels | 122, 124, 126 |
| wire channels | 128, 130, 132 |
| receiving slots | 136 |
| covering | 138 |
| insulated wires | 140, 142, 144 |
| cable channel | 148 |
| projections | 154 |
| angled slot | 155 |
| underside surface | 156 |
| connector | 160 |
| upper and lower parts | 162, 164 |
| slots | 166 |

What is claimed is:

1. An electrical connector, comprising:

a contact element bifurcated so as to define two opposed contact portions separated by a slot in which insulated wires may be successively positioned so that edges of the contact portions engage and displace the insulation of the wires and such that the contact portions resiliently engage and make electrical connection with the conductors of the wires, the opposed contact portions defining a slot side to side direction;

a body supporting said contact element, said body including a plurality of wire guides, each of said wire guides for guiding a wire during positioning, one of said wire guides defining a first guiding direction with a guiding path positioning a wire in contact with said two opposed contact portions in said slot at a first angle with respect to said slot side to side direction and another of said wire guides defining a second guiding direction with a guiding path positioning a wire in contact with said two opposed contact portions in said slot with at a second angle with respect to said slot side to side direction, said first angle being greater than said second angle.

2. An electrical connector as claimed in claim 1, wherein said wire guides are arranged to provide guiding directions whereby wires successively positioned in said slot are disposed in respective first and second dispositions, ones of the wires in said respective first and second dispositions extending at angles to said slot side to side direction which are respectively to opposite sides of a perpendicular to said slot side to side direction.

3. An electrical connector according to claim 1, further comprising a contact element support wherein said wire guides comprise channels arranged to extend at an angle to each other and to said slot side to side direction.

4. An electrical connector according to claim 3, wherein each of said channels extend inwardly with respect to an outer extent of said body and said channels define a longitudinal direction of extent with at least two longitudinal directions of extent crossing.

5. An electrical connector according to claim 4, wherein said channels are at different levels to define at least a deeper channel and a less deep channel, whereby an inner one of said wires with respect to a slot insertion direction is located in said deeper channel and an outer one of the wires with respect to a slot insertion direction is laid over said inner one of said wires in said less deep channel.

6. An electrical connector according to claim 3, wherein said body has a side defining said channels.

7. An electrical connector as claimed in claim 6, wherein said contact element is slidable with respect to said body, between a position at which it is at least substantially withdrawn from the channels and a position at which it is moved to make insulation displacement contact with wires received in the channels.

8. An electrical connector as claimed in claim 7, wherein the channels are peripherally closed and open at at least one end of each respective channel for longitudinal insertion of the wires.

9. An electrical connector as claimed in claim 3, wherein said channels are sidewardly open for receiving the wires.

10. An electrical connector as claimed in claim 9, wherein said contact element is slidable with respect to said body, between a position at which it is at least substantially withdrawn from the channels and a position at which it is moved to make insulation displacement contact with wires received in the channels.

11. An electrical connector as claimed in claim 10, wherein the channels are peripherally closed and open at at least one end of each respective channel for longitudinal insertion of the wires.

12. An electrical connector, comprising:

a bifurcated insulation displacement contact having opposed contact portions with a slot therebetween whereby insulated wires may be positioned in the slot such that the contact portions displace the insulation of the wires to make electrical connection to conductors of the wires;

a wire guide arrangement for locating the wires with respect to the contact including a first wire guide for positioning a wire in said slot in contact with each of said opposed contact portions to cause said opposed contact portions to be subjected to torsional forces in a first direction and a second wire guide for positioning a wire in said slot in contact with said opposed contact portions to cause said opposed contact portions to be subjected to torsional forces in a second direction that is substantially opposite said first direction.

13. A method of making electrical connection between electrically insulated wires and a bifurcated insulation displacement contact with contact portions defining a slot, the method comprising the steps of:

positioning a wire in the slot in contact with opposed contact portions of the contact with the wire subjecting the contact portions to first torsional forces;

positioning another wire in the slot in contact with opposed contact portions of the contact with the wire subjecting the contact portions to second torsional forces, said first torsional forces being substantially oppositely directed with respect to said second torsional forces.

14. A method of making electrical connection to wires having insulated conductors, the method comprising the steps of:

using a bifurcated contact element with two opposed contact portions separated by a slot; and positioning the wires in the slot in contact with each of said two opposed contact portions with said wires or a group of said wires, with substantially commonly aligned wires in each group, having a direction of extent arranged at an angle with respect to each other wire or each other group of wires to provide said wires with a direction which is substantially at opposite sides of perpendicular to a side to side direction of the slot, whereby edges of the contact portions engage and displace the insulation of said wires and such that the contact portions resiliently engage and make electrical connection with the conductors of the wires.

15. An electrical connector according to claim 1, wherein said contact element is formed of a generally planar element such that said slot side to side direction is substantially aligned with a plane of the contact element.

* * * * *